US006695411B2

(12) United States Patent
Leng et al.

(10) Patent No.: US 6,695,411 B2
(45) Date of Patent: Feb. 24, 2004

(54) FOLDING CHAIR

(75) Inventors: Luhao Leng, Xiamen (CN); Qiang Li, Xiamen (CN)

(73) Assignee: Xiamen New-Tech Jcc Co, Ltd., Xiamen (CN)

( * ) Notice: Subject to any disclaimer, the term of this patent is extended or adjusted under 35 U.S.C. 154(b) by 0 days.

(21) Appl. No.: 09/918,354

(22) Filed: Jul. 30, 2001

(65) Prior Publication Data

US 2002/0038970 A1 Apr. 4, 2002

(30) Foreign Application Priority Data

Sep. 29, 2000 (CN) ..... 00249493 U

(51) Int. Cl.[7] ..... A47C 7/02

(52) U.S. Cl. ..... 297/452.55; 297/440.2; 297/440.22; 297/440.16

(58) Field of Search ..... 297/452.55, 440.21, 297/440.2, 440.16, 440.22, 440.15, 441.14

(56) References Cited

U.S. PATENT DOCUMENTS 2,988,844 A * 6/1961 Frimberger ..... 446/115
3,233,942 A * 2/1966 Creutz ..... 297/463.2
3,575,465 A * 4/1971 Dolby et al. ..... 297/118
3,659,898 A * 5/1972 Yellin ..... 297/27
4,097,089 A * 6/1978 Petersen ..... 297/451.7
4,526,419 A * 7/1985 Bowman et al. ..... 297/153
5,000,512 A * 3/1991 Laird ..... 297/440.1
5,649,742 A * 7/1997 Liu ..... 297/440.22
5,730,489 A * 3/1998 Eberle et al. ..... 297/53
5,775,778 A * 7/1998 Riley et al. ..... 297/218.5
5,820,221 A * 10/1998 Greaves et al. ..... 297/378.14
5,951,103 A * 9/1999 Barnhill ..... 297/248
6,135,562 A * 10/2000 Infanti ..... 297/440.2

* cited by examiner

*Primary Examiner*—Peter M. Cuomo
*Assistant Examiner*—Erika Garrett
(74) *Attorney, Agent, or Firm*—Greer, Burns & Crain, Ltd.

(57) ABSTRACT

The invention disclosed a folding chair made up by metal tubes whose chair plate apparatus is formed by connecting between the frame member and the plate member by sleeves. The chair plate apparatus consists of the frame member and the plate member; on each side of the plate member is respectively provided with a sleeving; the frame member is provided with a fundamental part, for being leaned against the plate member; and the two side parts are inserted into the each sleeving. The folding chair in this invention is elastic and comfort to sit, much more materials are saved and therefore the cost is reduced.

17 Claims, 3 Drawing Sheets

FOLDING CHAIR

FIELD OF THE INVENTION

The present invention relates to a folding chair, more particularly to a folding chair made up by metal tubes whose chair plate apparatus is formed by a frame member inserting into sleeving of a plate member.

BACKGROUND OF THE INVENTION

The folding chair of prior art is usually provided by setting pivot shafts between the front legs and the back legs and between the chair plate apparatus and the front and back legs respectively. There are usually two kinds of structures for the folding chair usually. One is that the chair plate apparatus is connected directly to the front and back legs. The characteristic of this kind of chair is that the chair plate apparatus is too thick and the framework of the plate is not needed. This kind of structure is usually used in wooden folding chair. The other is that the carriage of the folding chair is made from metal tubes, the chair plate apparatus is fixed on the metal framework and the chair plate apparatus is formed by covering a layer of panel on to the framework as well as the plate member. In fact, the first kind of folding chairs in prior art will certainly wastes too much forest resources and is also too heavy because of its chair plate apparatus. It has been out of date and is gradually replaced by other alternatives. As regard to the second kind of folding chairs in prior art, its framework is closed; the panel could be changed to different fashion to meet with the requirements and fancy of the customer. In fact, this kind of folding chair of prior art is quite popular in the present market due to its deluxe appearance. However, Its disadvantage is that multiple screws are needed for being used to fix the panel and the frame member. Therefore the materials used for making the chair are too much; the assemble structure is too complex, thus the install operation is correspondingly too sophisticated.

SUMMARY OF THE INVENTION

The object of the present invention is to provide a folding chair, of which the fixing structure is provided through connecting between the frame member and the plate member by sleeves. Therefore the connecting structure on the chair plate apparatus of the folding chair in present invention is quite simple; it is much convenient for the assemble operation.

To achieve the above purpose, the present invention provides a folding chair which comprises a chair plate apparatus consisting of a frame member and a plate member, wherein each side of the plate member is respectively provided with a sleeving; the frame member provided with a fundamental part, for being leaned against the plate member; and two side parts, inserted into the each sleeving.

According to the folding chair of the present invention, at least a fastness device is used to lock the frame member and the plate member.

According to the folding chair of this invention, the fastness device comprises a screw; first screw hole, located at the fundamental part for being associated with the screw; and second screw hole, located at the plate member and aligned with the first screw hole.

According to the folding chair of present invention, a blind patch is provided to use for sealing an opening on the end of the sleeving after the two side parts being inserted.

According to the folding chair of present invention, several through-carved design is provided on the plate member.

According to the folding chair of this invention, a panel is covered with the plate member.

According to the folding chair of this invention, a front sleeve is used to package up the chair plate in the front.

According to the folding chair of this invention, the plate member comprises several plate units, each side of which is provided with a sleeving.

According to the folding chair of this invention, the chair plate apparatus is made of plastics.

As the sleeve structures are adopted in the connection of frame member and plate member, the plate member of the present invention may be made portably by plastics. And because plastics has very good extensional performance, the chair plate apparatus is elastic and comfort to sit, much more materials are saved and therefore the cost can be easily reduced.

BRIEF DESCRIPTION OF THE DRAWINGS

The above mentioned and the other advantage of the present invention will be apparently noted through the description combined with the following drawings and the preferred embodiments.

DESCRIPTION OF THE PREFERRED EMBODIMENTS

With the following description of the drawings and specific embodiments, the invention shall be further described in details.

Figure 2:
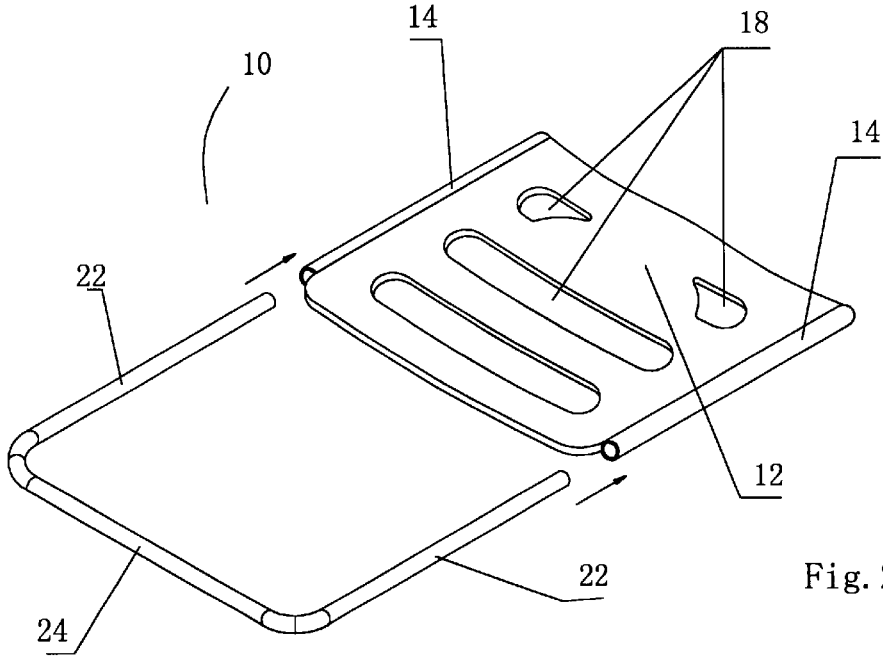
FIG. 2 is a diagrammatic sketch of the chair plate apparatus according to another preferred embodiment of the present invention, showing that several through-carved figure are designed on the plate member.

In FIG. 2, the chair plate apparatus 10 of a folding chair in a specific embodiment of the invention, respectively consists of: a plate member 12, of which on the two sides a sleeving 14 is installed; and a approximate U-type frame member 20, on which is set a fundamental part 24 of which the length is basically equal to the width of the plate member 12 and the two side parts 22. The two side parts 22 are perpendicular to the fundamental part 24 and respectively inserting in the two sleeves 14 of the plate member 12 in the direction the arrow shows. What's more in this invention, it is very convenient to fix the plate member 12 and the frame member 20 because, as shown in FIG. 2, the fastness device in the invention is one that fix the chair by screws. In the present invention, in the front of the fundamental part 24 and plate member 12 are respectively located a pair of screw holes 26 and 16 while the screw hole 26 on the fundamental part 24 is matching the screw hole on the plate member 12. Therefore, the screw 30 shall be very easily to pass through the screw holes 26 and 16 to lock the frame member 20 to the plate member 12 together. And to make it more beautiful, a blind patch 32 is installed on the chair plate apparatus 10 of the folding chair in the invention. When the two side parts 22 is inserted into the sleeves 14, a pair of the blind patches 32 shall sealing the opening on the ends of the two side parts 22.

According to the embodiments in the invention, as having employed above connecting structure, the plate member of the chair plate apparatus 10 could be made by light materials, such as plastics. So the outlook of the chair plate apparatus 10 has been improved and the material it occupied has been reduced, To increase the ventilating performance of the plate member 10, there are some hollow-carved figure parts 18 on the plate member 12, as shown in FIG. 2.

Figure 3:
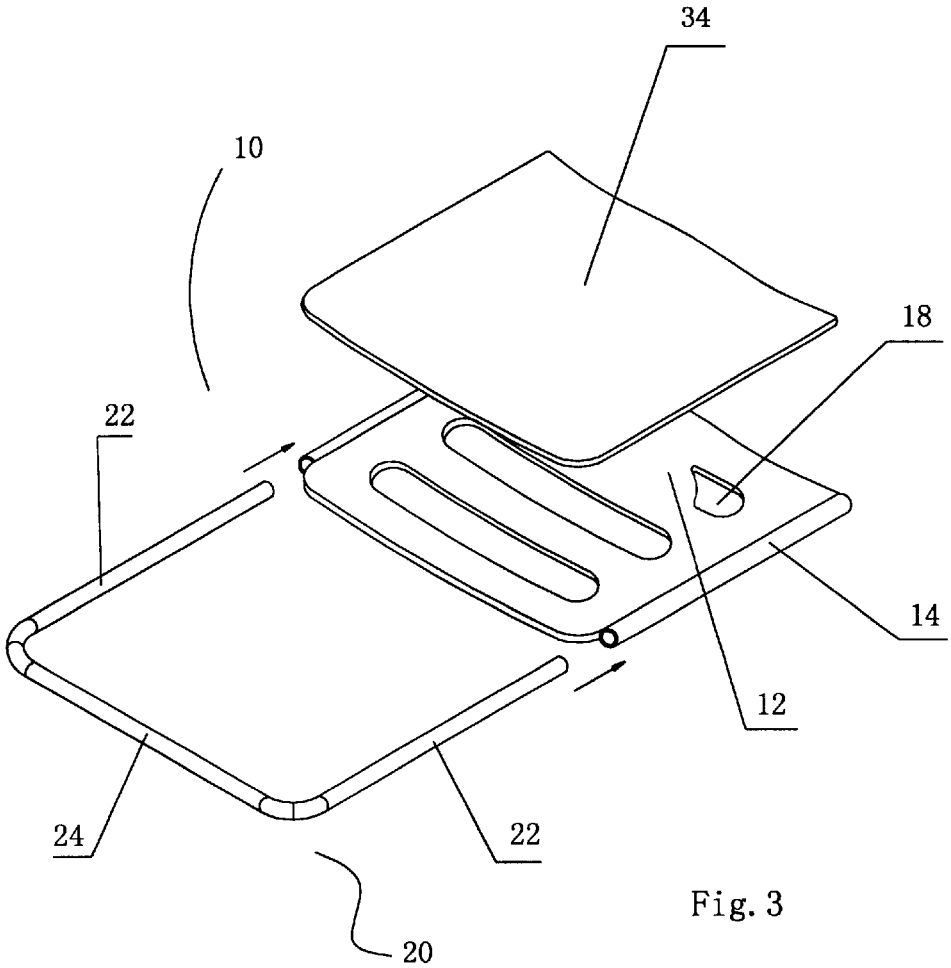
FIG. 3 is a diagrammatic sketch of the chair plate apparatus according to another preferred embodiment of the present invention, showing that the plate member is covered with a decorating plate.

FIG. 3 shows another specific embodiment of the chair plate apparatus 10 of the invention, which improves the comfort-ness and the design pattern of the chair plate apparatus 10 by setting a panel 34. When the two side parts 22 of the frame member 20 is inserted into the sleeves of the plate member 12 following the direction of the arrow, a panel 34, which may be made by cloth, sponge or wood, could be fixed on the plate member 12.

Figure 1:
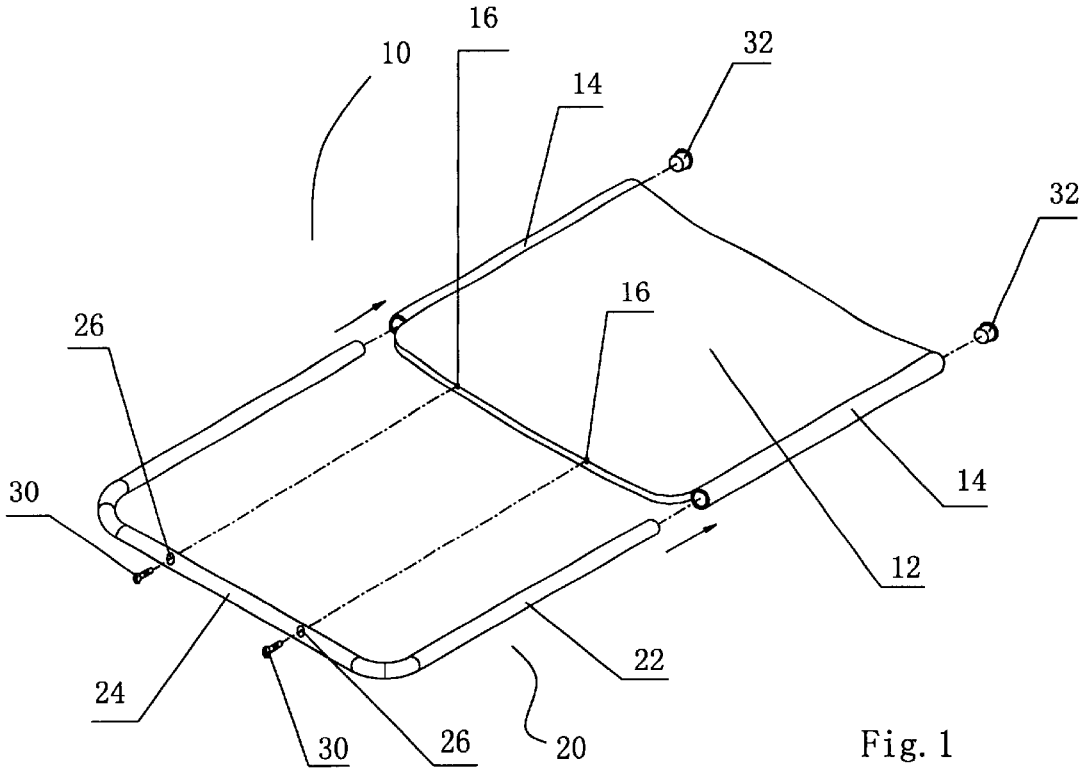
FIG. 1 is a diagrammatic sketch of the chair plate apparatus according to a preferred embodiment of the present invention.
Figure 4:
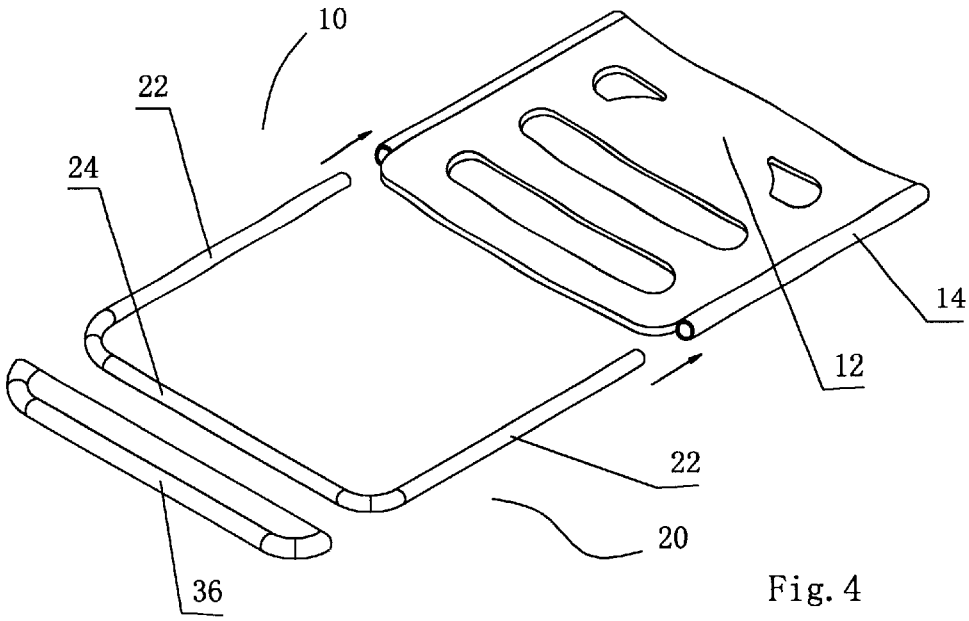
FIG. 4 is a diagrammatic sketch of the chair plate apparatus according to another preferred embodiment of the present invention, showing that a front shell is provided and used to package up the chair plate apparatus in the front.

In FIG. 4 is another specific embodiment of the chair plate apparatus 10 of the invention, on which a front sleeve 36 is covered. Therefore, when the frame member 20 is inserted into plate member 12, the front sleeve 36 in the front of the frame member 20 shall cover the fixing screws 30, as shown in FIG. 1, to improve the outlook of the chair plate apparatus and make it more beautiful.

Figure 5:
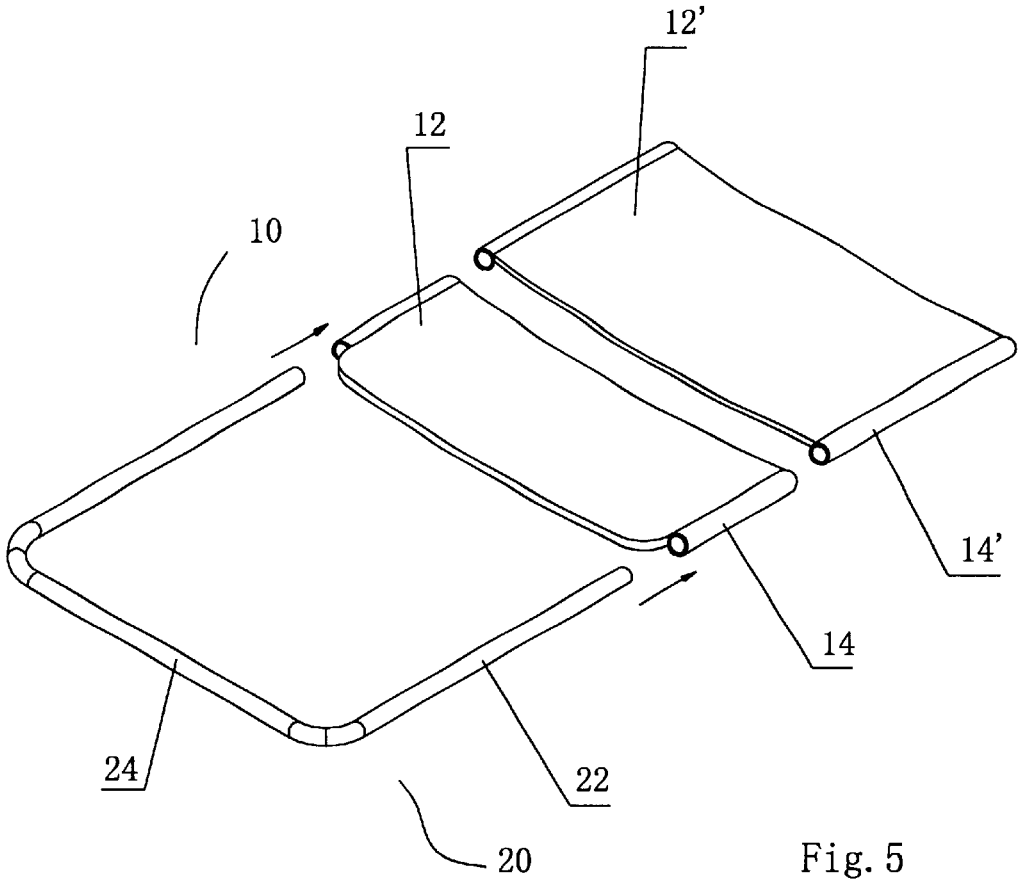
FIG. 5 is a diagrammatic sketch of the chair plate apparatus according to another preferred embodiment of the present invention, showing that the plate member consists of some plant units.

It is more especial that the plate member 12 of the invention could be divided to some plate units, as shown in FIG. 5. In this specific embodiment, it consists of two plate units 12 and 12'. There are two sleeves 14 and 14' on the sides of the two plate units 12 and 12'. Therefore, the side parts 22 can go through the two sleeves 14 and 14' of the two plate units 12 and 12' at same time. According to this embodiment, it is easier to insert the two parts 12 and 12' into the sleeves of the side parts 22. As the result, this invention makes the model structure of the plate member simpler, and when employing a small injecting machine as well as using deferent colors and different plate shape, the outlook more beautiful.

What is claimed is:

1. A folding chair comprising:

a generally U-shaped frame member defined by a fundamental part and two side parts disposed at opposite ends of said fundamental part; and at least one plate member having two opposing sides, wherein said at least one plate member comprises a plurality of plate members, a sleeving provided on each of said two opposing sides for slidingly receiving said side parts, said sleevings configured to enclose said side parts, said fundamental part being abutted against said plate member when said side parts are received in said; and wherein said sleevings are tubular shaped to completely enclose a received portion of said corresponding side parts and are discontinuous with one another.

2. A folding chair according to claim 1 wherein said at least one plate member has a front with generally rounded corners, and wherein said frame fundamental part has two generally rounded ends configured to match said plate member rounded corners.

3. A folding chair according to claim 1 wherein a fastener device is provided for locking said frame member to said plate member.

4. A folding chair according to claim 1, wherein said plate member has a front with at least a first screw hole, said frame fundamental part has at least a second screw hole aligned with said first screw hole, and wherein at least one fixing screw is provided for inserting into said first and second screw holes to fix said plate member to said frame member.

5. A folding chair according to claim 4 wherein a detachable front sleeve is provided, said front sleeve configured for attachment to said frame fundamental part and to cover said at least one fixing screw.

6. A folding chair according to claim 1, wherein said two side parts are perpendicular to said fundamental part, wherein said frame member is substantially co-planar with said plate member when said frame member side parts are received in said sleevings, wherein said plate member has a width between said sleevings, and wherein said frame fundamental part has a width that is basically equal to said plate member width.

7. A folding chair according to claim 1 wherein said frame member side parts each have a front end and a distal back end, said frame member fundamental part connecting said side part rear ends, wherein said plate member sleevings are configured to slidingly receive said frame member with said side part front ends inserted first and urged inward until said frame fundamental part contacts said plate member.

8. A folding chair according to claim 1 wherein a panel is provided for fixing on said plate member, said panel being generally the same size as said plate member.

9. A folding chair according to claim 8 wherein said panel is made of one or more of cloth, sponge, or wood.

10. A folding chair according to claim 1 wherein a detachable front sleeve is provided for covering at least said fundamental part of said frame member when said frame member side parts are inserted in said sleevings.

11. A folding chair according to claim 10 wherein said fundamental part has two ends connected to said side parts, and wherein said detachable front sleeve is configured to cover said two ends.

12. A folding chair according to claim 1 further including a plurality of said at least one plate member, wherein each of said plurality of plate members have sleevings at opposite ends, and wherein said sleevings from individual members of said plurality of plate members are configured to be generally continuous with sleevings from adjacent others of said plurality of plate members, and said adjacent plate members are generally co-planar and abut each other along a common edge.

13. A folding chair according to claim 1 further including a plurality of said at least one plate member, wherein said plurality of plate members are configured to be adjacent and generally co-planar with one another when said frame is received in said and a first of said plurality of plate members has a front edge with generally curved corners configured to cooperate with said frame member fundamental part, said first plate member having a substantially straight back edge, and wherein a second of said plurality of plate members has a substantially straight front and back edge, said second plate member front edge configured to cooperate with said first plate member back edge.

14. A folding chair according to claim 1 wherein each of said plurality of plate members has a different color.

15. A folding chair comprising:

a generally U-shaped frame member, said U-shaped frame member defined by a fundamental part and two side parts disposed at opposite ends of said fundamental part and generally perpendicular to said fundamental part, said fundamental part having at least a first pair of screw holes;

at least one plate member having two opposing sides and a front edge, wherein said at least one plate member comprises a plurality of plate members, a sleeving provided on each of said two opposing sides, said sleevings being cylindrical shaped and configured to slidingly receive one of said side parts and to enclose at least a portion of said one side part, said fundamental part being abutted against said plate member front edge when said side parts are received in said sleevings, said front edge having at least a second pair of screw holes aligned with said first pair of screw holes;

a pair of fixing screws for inserting through said first and second pairs of aligned screw holes to fix said frame member to said plate member; and a detachable front sleeve for attaching to said fundamental part, said detachable front sleeve configured to cover said pair of fixing screws.

16. A folding chair comprising:

a generally U-shaped frame member, said U-shaped frame member defined by a fundamental part and two side parts disposed at opposite ends of said fundamental part; and a plurality of plate members, each of said plate members having sleevings configured to slidingly receive said side parts, said plurality of plate members configured to be substantially co-planar with and adjacent to one another;

said sleevings are tubular shaped to completely enclose a received portion of said corresponding side parts and are discontinuous with one another;

said at least one plate member has a front with generally rounded corners, and wherein said frame fundamental part has two generally rounded ends configured to match said plate member rounded corners;

said plate member has a front with at least a first screw hole, said frame fundamental part has at least a second screw hole aligned with said first screw hole, and wherein at least one fixing screw is provided for inserting into said first and second screw holes to fix said plate member to said frame member; and a detachable front sleeve is provided, said front sleeve configured for attachment to said frame fundamental part and to cover said at least one fixing screw.

17. A folding chair according to claim 16 wherein each of said plurality of plate members are of a different color.

* * * * *